United States Patent [19]

Tanaka et al.

[11] 4,147,554

[45] Apr. 3, 1979

[54] DIRECT-POSITIVE PHOTOGRAPHIC SILVER HALIDE EMULSION

[75] Inventors: Akira Tanaka; Mamoru Nakatani; Akio Yoshida, all of Nagaokakyo, Japan

[73] Assignee: Mitsubishi Paper Mills, Ltd., Tokyo, Japan

[21] Appl. No.: 778,328

[22] Filed: Mar. 16, 1977

[30] Foreign Application Priority Data

Apr. 2, 1976 [JP] Japan ..... 51-36935

[51] Int. Cl.[2] ..... G03C 1/16

[52] U.S. Cl. ..... 96/130; 96/101

[58] Field of Search ..... 96/130, 101, 84 R

[56] References Cited

U.S. PATENT DOCUMENTS

| | | | |
|---|---|---|---|
| 2,525,520 | 10/1950 | Brooker et al. | 96/130 |
| 3,598,603 | 8/1971 | Chapman | 96/130 |
| 3,600,184 | 8/1971 | Brooker et al. | 96/130 |
| 3,925,085 | 12/1975 | Sato et al. | 96/101 |
| 3,941,602 | 3/1976 | Depoorter et al. | 96/101 |
| 3,945,832 | 3/1976 | Shiba et al. | 96/130 |

*Primary Examiner*—J. Travis Brown

*Attorney, Agent, or Firm*—Cushman, Darby & Cushman

[57] ABSTRACT

Direct-positive photographic silver halide emulsion which contains a dye having a 5,6-dihydropyrrolo[2,1-a]isoquinoline ring is disclosed. Said emulsion has a high speed, produces high contrast images, has no color stain with any remaining dye after processing and causes only small depression in the maximum density.

20 Claims, No Drawings

DIRECT-POSITIVE PHOTOGRAPHIC SILVER HALIDE EMULSION

BACKGROUND OF THE INVENTION

This invention relates to direct-positive photographic silver halide emulsions and more particularly it relates to direct-positive photographic silver halide emulsions which are spectrally sensitized with novel dyes containing 5,6-dihydropyrrolo[2,1-a]isoquinoline ring.

Usually, a negative image is obtained by subjecting a photosensitive silver halide material to a suitable exposure and then to a development. Furthermore, there has also been known the reversal phenomenon according to which a positive image is obtained by exposing a certain photosensitive silver halide material and then developing thus exposed photosensitive material. This reversal phenomenon includes Herschel effect, Villard effect, solarization, etc., among which the solarization has been used for the direct-positive photosensitive silver halide materials of high speed. The solarization is such a phenomenon that when a photosensitive silver halide material is exposed to light including its sensitive region and then is developed, the optical density which increases with exposure in the optimum region begins to decrease with exposure in the overexposure region. This solarization is also observed in photosensitive silver halide materials which have been fogged with light or a chemical fogging agent to an appropriate extent and a direct-positive image can be obtained.

According to this invention, it is intended to obtain high-speed direct-positive photographic silver halide emulsions effectively spectrally sensitized in the blue, or green, or red region by novel spectral-sensitizing dyes containing 5,6-dihydropyrrolo[2,1-a]isoquinoline ring.

Many dyes have been known as spectral sensitizers for the usual negative emulsions. However, use of these dyes as spectral sensitizer for direct-positive silver halide emulsions often results in various problems, e.g. low contrast (flattening) of characteristic curves, re-reversal (a phenomenon owing to which the optical density increases again with exposure over the solarization region), etc.

Furthermore, many of the dyes known as spectral sensitizers for direct-positive silver halide emulsions, for example, those disclosed in U.S. Pat. No. 3,431,111, have the defect that they cause color stain based on the dye which remains even after processing of photosensitive materials.

SUMMARY OF THE INVENTION

As the result of researches on direct-positive sensitizing dyes giving a high-speed and having no defects as mentioned above, we have now succeeded in obtaining the sensitizing dyes which satisfy these requirements.

Accordingly, it is an object of this invention to provide high-speed direct-positive photographic silver halide emulsions using novel dyes containing 5,6-dihydropyrrolo[2,1-a]isoquinoline ring.

Another object of this invention is to provide direct-positive photographic silver halide emulsions with no color stain caused by the remaining dyes using novel dyes containing 5,6-dihydropyrrolo[2,1-a]isoquinoline ring.

Still another object of this invention is to provide high contrast direct-positive photographic silver halide emulsions using novel dyes containing 5,6-dihydropyrrolo[2,1-a]isoquinoline ring.

Still another object of this invention is to provide direct-positive photographic silver halide emulsions exhibiting small depression in maximum density which is often observed at the addition of dyes with use of novel dyes containing 5,6-dihydropyrrolo[2,1-a]isoquinoline ring.

DESCRIPTION OF THE INVENTION AND THE PREFERRED EMBODIMENTS

The novel dyes containing 5,6-dihydropyrrolo[2,1-a]isoquinoline ring which are used in this invention are represented by the following general formula:

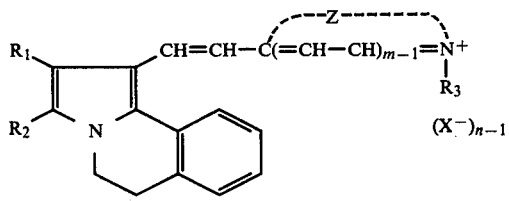

[wherein $R_1$ is an alkyl group of 1–6 carbon atoms (e.g., methyl, ethyl, propyl, isopropyl, butyl, tert-butyl, pentyl, hexyl, etc.), a cycloalkyl group of 3–6 carbon atoms (e.g., cyclopropyl, cyclohexyl, etc.), an aralkenyl group (e.g., styryl), an aryl group which may have a substituent (e.g., phenyl, o-tolyl, p-tolyl, p-tert-butylphenyl, 1,3,5-trimethylphenyl, o-methoxyphenyl, p-methoxyphenyl, p-tert-octyloxyphenyl, m-chlorophenyl, p-chlorophenyl, o-fluorophenyl, m-nitrophenyl, p-nitrophenyl, p-aminophenyl, m-acetamidophenyl, p-benzamidophenyl, 3-chloro-4-ethoxyphenyl, 4-methyl-3-nitrophenyl, 4-benzyloxy-3-bromophenyl, 5-chloro-4-methoxyphenyl, 3,5-dichloro-4-ethoxyphenyl, m-sulfophenyl, m-fluorosulfonylphenyl, 3,5-difluorosulfonylphenyl, 2-methoxy-5-fluorosulfonylphenyl, p-cyanophenyl, p-carboxyphenyl, p-ethoxycarbonylphenyl, etc.), a 5- or 6-membered ring (e.g., 2-furyl, 3-pyridyl, 4-pyridyl, etc.), a carboxyl group, an alkoxycarbonyl group of 1–6 carbon atoms (e.g., methoxycarbonyl, ethoxycarbonyl, propoxycarbonyl, isopropoxycarbonyl, butoxycarbonyl, etc.), a carbamoyl group which may be substituted with aryl or alkyl group (e.g., carbamoyl, N-phenylcarbamoyl, N-methylcarbamoyl, N-ethylcarbamoyl, N-butylcarbamoyl, N,N-dimethylcarbamoyl, N,N-diethylcarbamoyl, N,N-dibutylcarbamoyl, etc. and furthermore, nitrogen atom of the carbamoyl may be a part of such ring as piperidine or morpholine, etc.) or an acyl group (e.g., acetyl, propionyl, benzoyl, phenylacetyl, etc.), $R_2$ is hydrogen atom or the alkyl, aryl, carboxyl, alkoxycarbonyl, carbamoyl or acyl group as defined on $R_1$, $R_3$ is the alkyl group as defined on $R_1$, a substituted alkyl group (e.g., hydroxyalkyl group such as β-hydroxyethyl, γ-hydroxypropyl, etc., acyloxyalkyl group such as β-acetoxyethyl, γ-acetoxypropyl, β-benzoyloxyethyl, etc., alkoxyalkyl group such as β-methoxyethyl, β-ethoxyethyl, β-isopropoxyethyl, β-(β-methoxyethoxy)ethyl, etc., carboxyalkyl group such as carboxymethyl, β-carboxymethyl, γ-carboxypropyl, etc., alkoxycarbonylalkyl group such as methoxycarbonylmethyl, ethoxycarbonylmethyl, β-ethoxycarbonylethyl, etc., sulfoalkyl group such as β-sulfoethyl, γ-sulfopropyl, δ-sulfobutyl, etc.), an alkenyl group (e.g., allyl, etc.), an aralkyl group (e.g., benzyl, phenethyl, etc.) or the aryl group as defined on $R_1$; Z represents a group of non-metal atoms necessary for completion of a 5- or 6-membered nitrogen containing heterocyclic nucleus, examples of which are oxazoline nuclei, oxazole nuclei (e.g., 4-methyloxazole, 5-methyloxazole, 4-phenyloxazole, 5-phenyloxazole, 4,5-diphenyloxazole, etc.), benzoxazole nuclei (e.g., benzoxazole, 5-chlorobenzoxazole, 5-methylbenzoxazole, 5-phenylbenzoxazole, 5,6-dimethylbenzoxazole, 5-methoxybenzoxazole, 5-ethoxybenzoxazole, 6-methoxybenzoxazole, 5-acetylbenzoxazole, 5-benzoylbenzoxazole, 5-chloro-6-methylbenzoxazole, 5-carboxybenzoxazole, 5-ethoxycarbonylbenzoxazole, 5-nitrobenzoxazole, 6-nitrobenzoxazole, 5-chloro-6-nitrobenzoxazole, 5-hydroxybenzoxazole, 6-hydroxybenzoxazole, etc.), naphthoxazole nuclei (e.g., α-naphthoxazole, β,β-naphthoxazole, β-naphthoxazole, etc.), thiazoline nuclei (e.g., thiazoline, 5-methylthiazoline, etc.), thiazole nuclei (e.g., thiazole, 4-methylthiazole, 4-phenylthiazole, 5-methylthiazole, 5-phenylthiazole, 4,5-dimethylthiazole, 4,5-diphenylthiazole, etc.), benzothiazole nuclei (e.g., benzothiazole, 4-chlorobenzothiazole, 5-chlorobenzothiazole, 6-chlorobenzothiazole, 7-chlorobenzothiazole, 5-methylbenzothiazole, 6-methylbenzothiazole, 5,6-dimethylbenzothiazole, 5-bromobenzothiazole, 6-bromobenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 5-methoxycarbonylbenzothiazole, 5-ethoxybenzothiazole, tetrahydrobenzothiazole, 5-N,N-dimethylaminobenzothiazole, 5,6-dimethoxybenzothiazole, 5-hydroxybenzothiazole, 6-hydroxybenzothiazole, 5-carboxybenzothiazole, 5-nitrobenzothiazole, 6-nitrobenzothiazole, 5-chloro-6-nitrobenzothiazole, 5,6-methylenedioxybenzothiazole, etc.), naphthothiazole nuclei (e.g., α-naphthothiazole, β-naphthothiazole, 5-methoxy-β-naphthothiazole, 5-ethoxy-β-naphthothiazole, 8-methoxy-α-naphthothiazole, 7-methoxy-α-naphthothiazole, etc.), selenazole nuclei (e.g., 4-methylselenazole, 4-phenylselenazole, etc.), benzoselenazole nuclei (e.g., benzoselenazole, 5-chlorobenzoselenazole, 5-methoxybenzoselenazole, 5-hydroxybenzoselenazole, tetrahydrobenzoselenazole, etc.), naphthoselenazole nuclei (e.g., α-naphtoselenazole, β-naphthoselenazole, etc.), 2-pyridine nuclei (e.g., pyridine, 3-methylpyridine, 4-methylpyridine, 5-methylpyridine, 3,4-dimethylpyridine, 4-chloropyridine, 3-hydroxypyridine, 3-phenylpyridine, etc.), 4-pyridine nuclei (e.g., pyridine, 2-methylpyridine, 3-methylpyridine, 3-chloropyridine, 2,6-dimethylpyridine, 3-hydroxypyridine, etc.), 2-quinoline nuclei (e.g., quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, etc.), 4-quinoline nuclei (e.g., quinoline, 6-methoxyquinoline, 7-methylquinoline, 8-methylquinoline), 1-isoquinoline nuclei (e.g., isoquinoline, 3,4-dihydroisoquinoline, etc.), 3-isoquinoline nuclei (e.g., isoquinoline, 5-methylisoquinoline, 1-methylisoquinoline, 6-chloroisoquinoline, 6-methoxyisoquinoline, 8-methoxyisoquinoline, etc.), imidazole nuclei (e.g., 1-methylimidazole, 1-ethyl-4-phenylimidazole, 1-butyl-4,5-dimethylimidazole, etc.), benzimidazole nuclei (e.g., 1-methylbenzimidazole, 1-butyl-4-methylbenzimidazole, 1-ethyl-5,6-dichlorobenzimidazole, etc.), naphthoimidazole nuclei (e.g., 1-methyl-α-naphthoimidazole, 1-ethyl-β-naphthoimidazole, etc.), indolenine nuclei (e.g., 3,3-dimethylindolenine, 3,3,5-trimethylindolenine, 3,3,7-trimethylindolenine, 5-hydroxy-3,3-dimethylindolenine, 6-chloro-3,3-dimethylindolenine, 3,3-dimethyl-5-nitroindolenine, etc.), imidazo[4,5-b]quinoxaline nuclei (e.g., 1,3-diethylimidazo[4,5-b]quinoxaline, 1,3-diethyl-6-nitroimidazo[4,5-b]quinoxaline, 1,3-diphenylimidazo[4,5-b]quinoxaline, 6-chloro-1,3-diphenylimidazo[4,5-b]quinoxaline, 1,3-diallylimidazo[4,5-b]quinoxaline, etc.), 2-naphthyridine(1,8-)nuclei (e.g., 1,8-naphthyridine, 4-methyl-1,8-naphthyridine, 6-methyl-1,8-naphthyridine, 7-methyl-1,8-naphthyridine, etc.), 4-naphthyridine(1,8)nuclei (e.g., 1,8-naphthyridine, 2-methyl-1,8-naphthyridine, 5-methyl-1,8-naphthyridine, 6-methyl-1,8-naphthyridine, 2,7-dimethyl-1,8-naphthyridine, etc.), pyrroline nuclei, etc.; $X^-$ represents an acid anion (e.g., methyl sulfate ion, ethyl sulfate ion, thiocyanate ion, p-toluene sulfonate ion, chloride ion, bromide ion, iodide ion, perchlorate ion, etc.) and m and n are 1 or 2.

Typical examples of the dyes used in this invention are enumerated below.

(1)

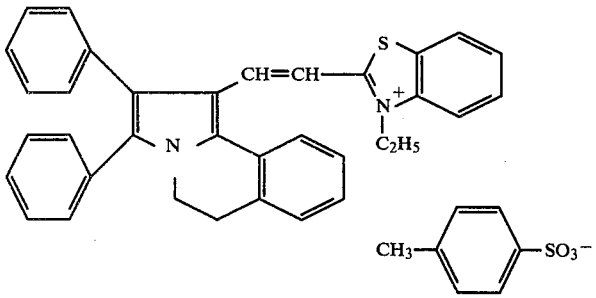

(2)

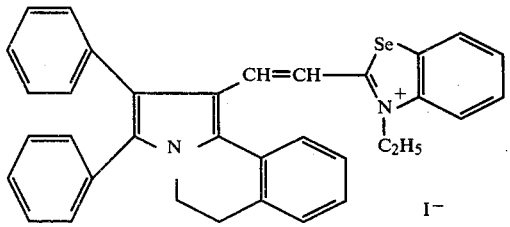

-continued
(3)
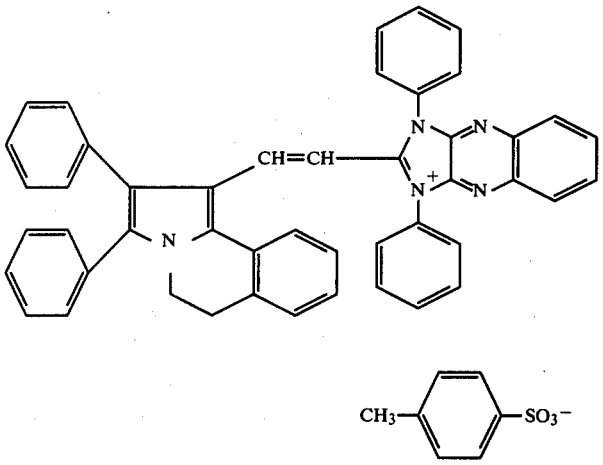
(4)
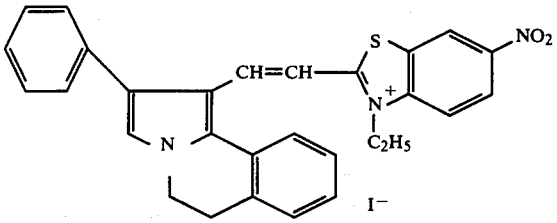
(5)
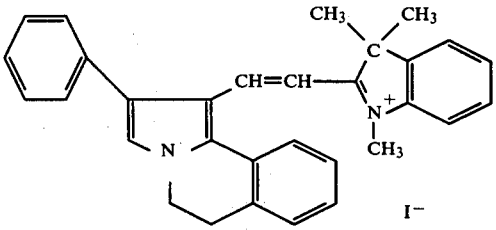
(6)
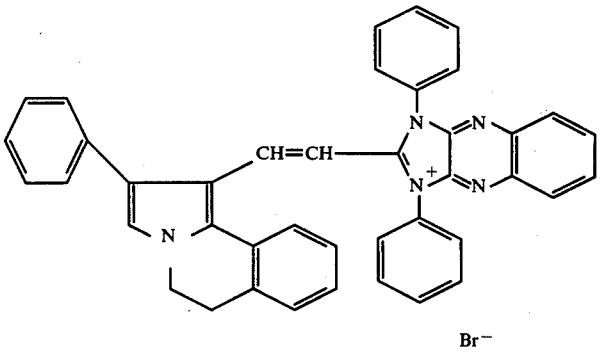
(7)
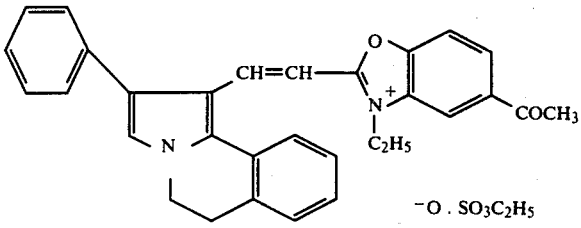

-continued
(8)
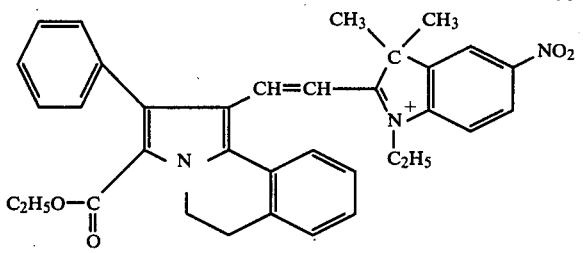
(9)
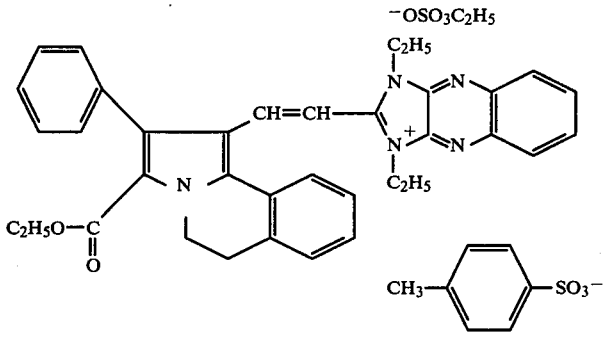
(10)
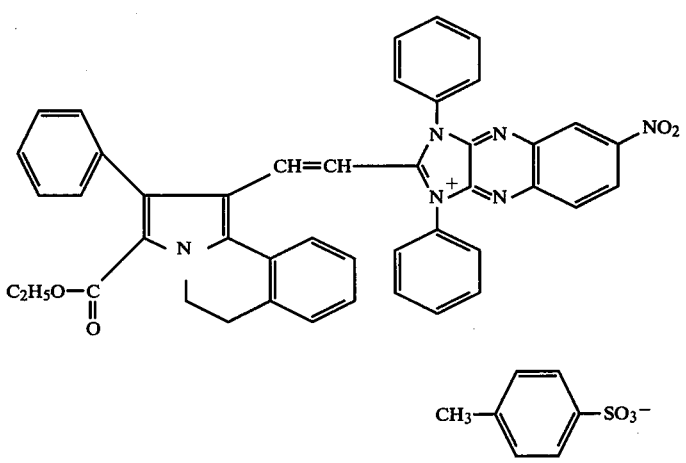
(11)
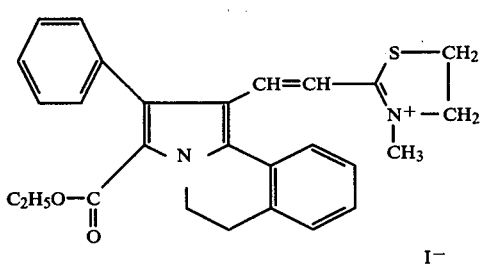
(12)
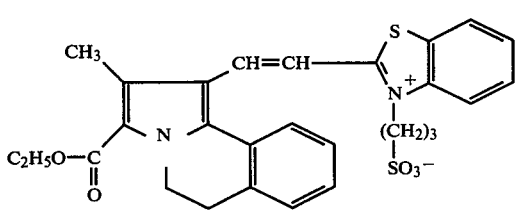
(13)
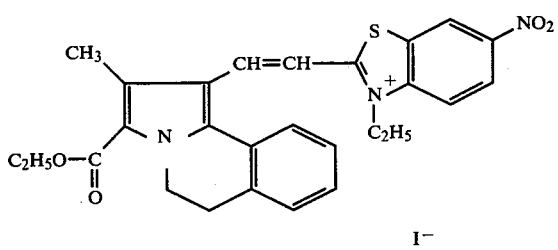

-continued
(14)
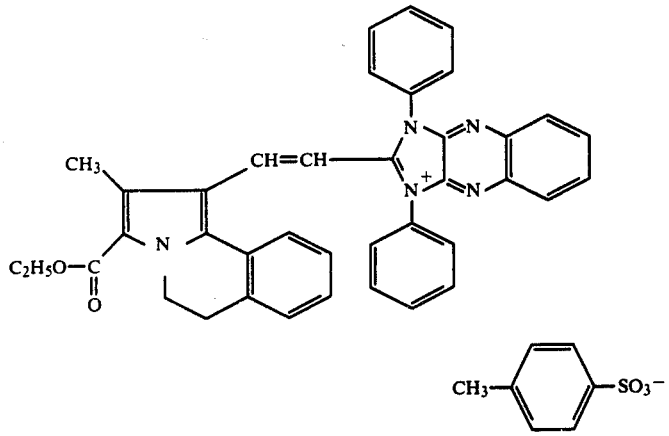
(15)
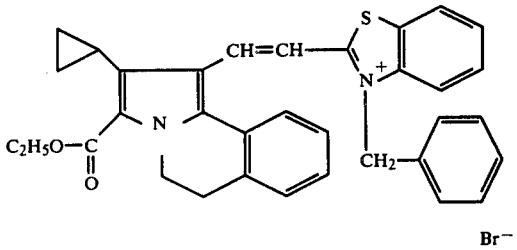
(16)
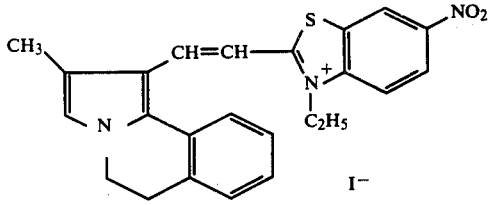
(17)
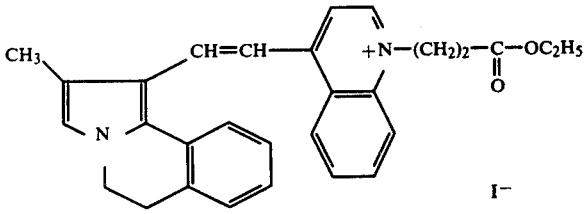
(18)
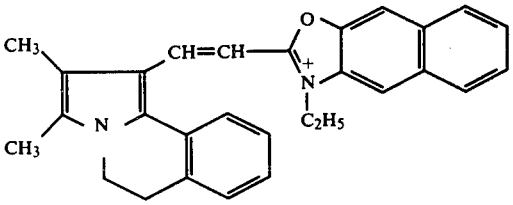
(19)
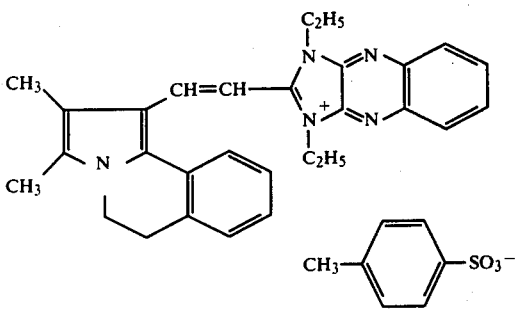

-continued
(20)
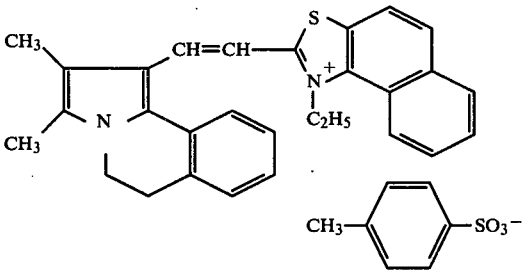
(21)
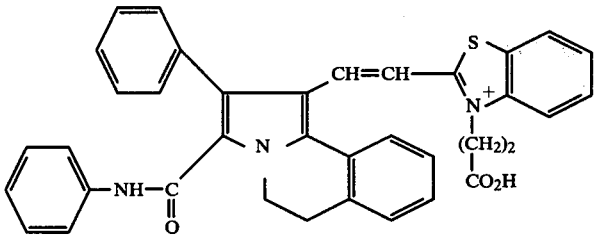
(22)
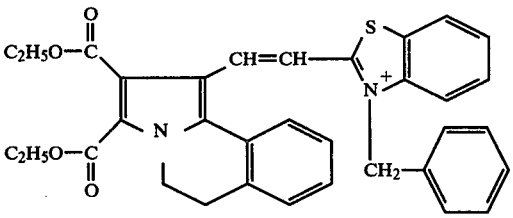
(23)
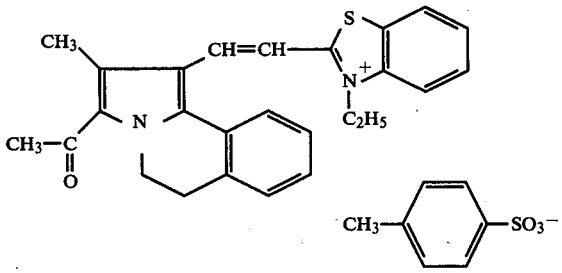
(24)
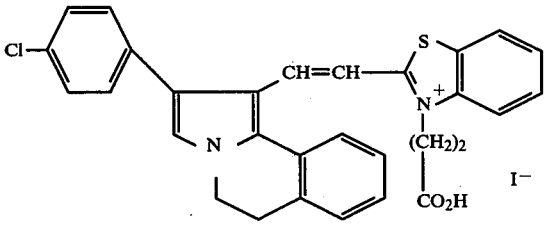
(25)
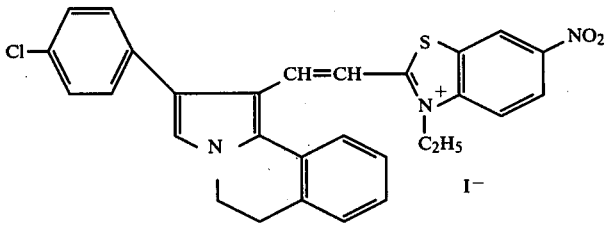

-continued
(26)
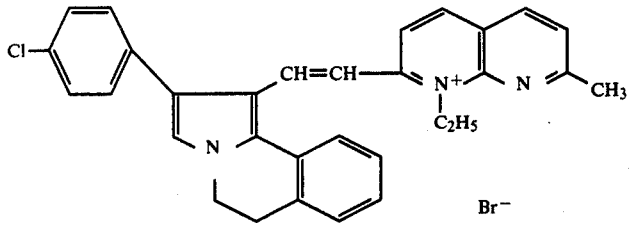
(27)
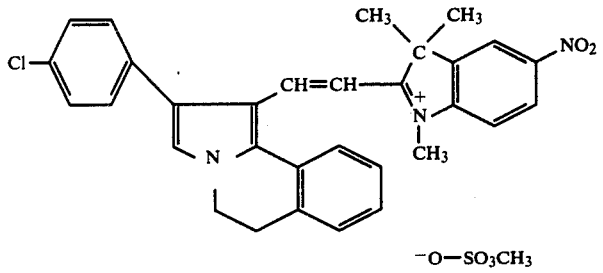
(28)
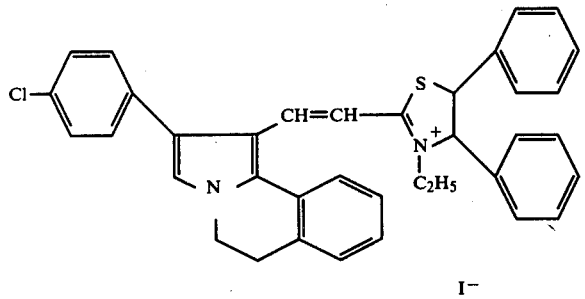
(29)
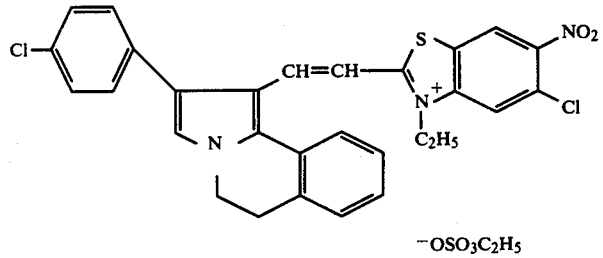
(30)
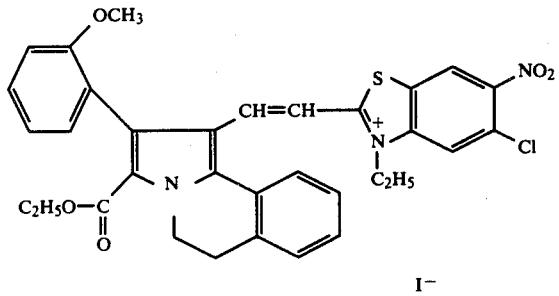
(31)
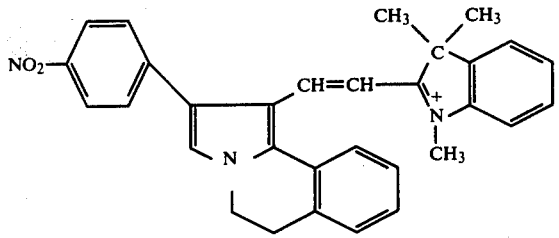

-continued (32)

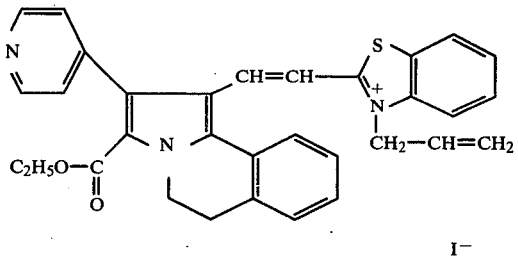

(33)

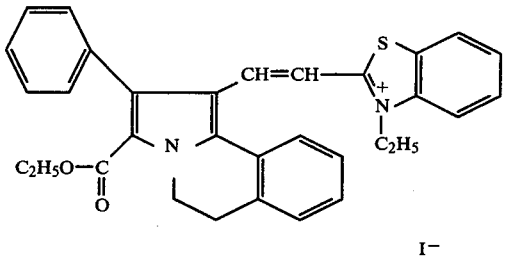

(34)

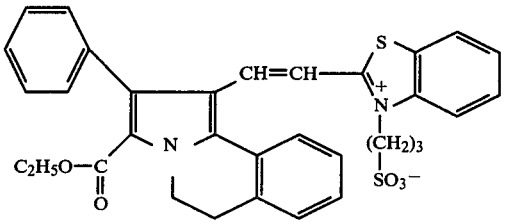

(35)

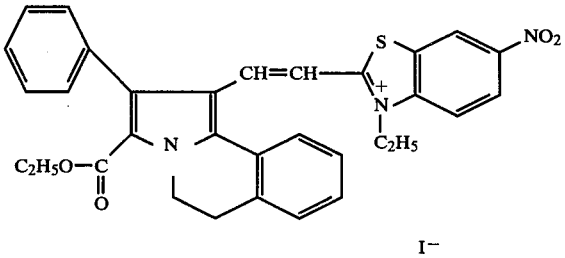

(36)

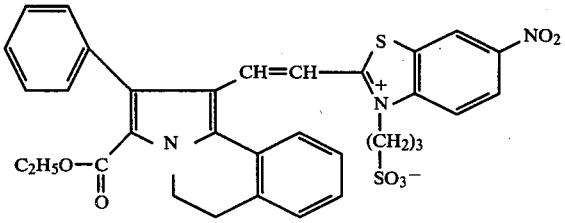

(37)

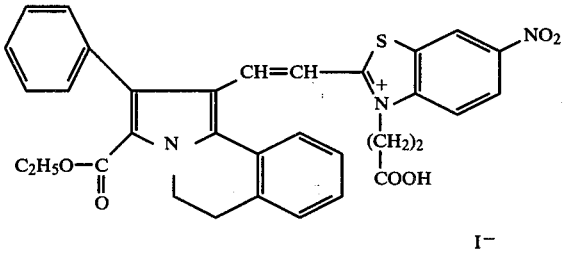

The dyes represented by the general formula mentioned above, which are used in this invention may be synthesized as follows: For example, 5,6-dihydropyrrolo[2,1-a]isoquinolines obtained by the methods disclosed in "Chemische Berichte" 91, 1546 (1958), "Chemical & Pharmaceutical Bulletin" 13, 775 (1965), "Journal of the Pharmaceutical Society of Japan" 86, (9) 856(1966), etc. are subjected to the so-called Vilsmeier-Haack reaction with N,N-dimethylformamide and phosphorus oxychloride to obtain a carbaldehyde derivative, which is then reacted with a heterocyclic quaternary ammonium salt having active methyl group in acetic anhydride with heating to obtain the dye represented by said general formula. Said carbaldehyde derivative may also be reacted with a heterocyclic ammonium salt having active methyl group under the presence of an organic base (such as triethylamine, piperidine, etc.) in an inert solvent (such as ethanol, nitrobenzene, etc.) in place of said acetic anhydride with heating to obtain the dye.

Typical example of synthesis of the dyes used in this invention are shown below.

Synthesis of dye (20) enumerated above:

(I) 4.0 ml of phosphorus oxychloride was added dropwise to 12.0 ml of dimethylformamide while being cooled with ice and stirred. To the mixture was added dropwise a solution prepared by dissolving 4.18 g of 2,3-dimethyl-5,6-dihydropyrrolo[2,1-a]isoquinoline in 20.9 ml of dimethylformamide and the resultant mixture was stirred at 35°–40° C. for 1 hour. The reaction mixture was cooled, poured in ice water and rendered alkaline with 5N-NaOH. This was heated on a water bath for about 5–6 minutes and then cooled with ice bath. The precipitated solid was collected on filter and washed with water. This was recrystallized with ethanol and dried to obtain 4.14 g of light brown crystalline powders having a melting point of 125°–126° C.

(II) 0.47 g of 2,3-dimethyl-5,6-dihydropyrrolo[2,1-a]isoquinoline-1-carbaldehyde obtained in the above reaction (I) and 0.80 g of 3-ethyl-2-methyl-β-naphthothiazolium-p-toluene sulfonate were refluxed for 10 minutes in 4.0 ml of acetic anhydride. The reaction product was cooled to room temperature and ether was added thereto. This was agitated and the supernatant liquid was removed by decantation. The same operation was repeated twice and then the precipitate was treated with 10 ml of acetone to obtain a crude dye. This was recrystallized with ethanol and dried to obtain 0.54 g of brown crystalline powders having metallic luster.

Other dyes used in this invention can also be easily synthesized in accordance with the above method.

Melting point and absorption maximum wavelength in methanol of the representative dyes are shown below.

| | Melting point (° C.) | | $\lambda_{max}^{CH_3OH}$ (nm) |
|---|---|---|---|
| Dyes (1) | 214.0 | (decomp.) | 490 |
| (3) | 297.0 | " | 520, 432 |
| (4) | 244.0 | " | 561 |
| (5) | 262.0 | " | 541 |
| (6) | 317.0 | " | 562 |
| (7) | 204.0 | " | 560 |
| (8) | 228.0 | " | 504 |
| (9) | 245.0 | " | 461 |
| (10) | 291.0 | " | 510 |
| (13) | 247.0 | " | 472 |
| (14) | 286.0 | " | 492 |
| (16) | 284.0 | " | 560 |
| (17) | 224.0 | " | 553 |
| (18) | 273.0 | " | 486 |
| (19) | 204.0 | " | 512 |
| (20) | 225.0 | " | 506 |
| (25) | 195.0 | " | 559 |
| (28) | 268.0 | " | 542 |
| (29) | 254.0 | " | 524 |
| (31) | 280.0 | " | 542 |
| (33) | 217.0 | " | 453 |
| (34) | 267.0 | " | 454 |
| (35) | 251.0 | " | 483 |
| (36) | 286.0 | " | 484 |
| (37) | 179.0 | " | 481 |

The photographic silver halide emulsions according to this invention include, e.g., emulsions of silver chloride, silver bromide, silver chloroiodide, silver iodobromide, silver chloroiodobromide, etc. and silver bromide or silver iodobromide emulsion is preferable for a high-speed direct-positive emulsion. Grain size of said silver halide may have the range of usually employed, but a mean grain size of less than about 0.5μ gives especially good result. The photographic silver halide emulsions according to this invention include both of monodispersed and non-monodispersed emulsions, but the former is more preferable. The "monodispersed emulsions" are those prepared so that at least 95%, by weight, of the photographic silver halide grains can have a diameter which is within about 40%, preferably within about 30%, of the mean grain diameter as disclosed in U.S. Pat. No. 3,501,305. Furthermore, the silver halide crystal grains used in this invention may have any crystal habit, but cubic crystal grains are preferable.

Both the regular and irregular silver halide grains can be used in this invention, but the regular grains are preferable. The regular grains are grains without twinning plane and the irregular grains are grains having twinning plane, as disclosed in U.S. Pat. No. 3,501,306. Preferably, at least 80%, by weight, of the silver halide grains is regular.

Furthermore, emulsion in which silver halide grains are capable of trapping free electrons in the interior and are fogged with a chemical fogging agent at the surface may also be used in this invention. Emulsions of this type have the characteristics that they are apt to exhibit solarization and their properties are suitable to form a direct-positive image with ease. The effect of such emulsions can be further increased by spectral sensitization with sensitizing dyes. Preparation of emulsions of this type is disclosed in, for example, U.S. Pat. Nos. 3,367,778, 3,632,340 and 3,709,689.

The photographic silver halide emulsions according to this invention are fogged with light or chemical fogging agents. Chemical fogging speck are given by various methods for chemical sensitization and particularly good results are obtained with techniques of the type described by Antoine Hautot and Henri Saubenier in Science et Industries Photographiques, Vol. 28, pp 57 to 65 (1957). Fogging can be effected with a reducing agent such as stannous chloride, thiourea dioxide, formalin, alkali arsenite, hydrazine derivatives, amine borane.

Furthermore, according to this invention the reducing agents in combination with compounds of a metal more electropositive than silver can be preferably used in fogging the silver halide grains. Examples of said compounds are gold compounds such as potassium chloroaurate, platinum compounds such as potassium chloroplastinate, and iridium compounds such as potassium hexachloroiridate. Preferred fogging can also be obtained by combinations of the above mentioned fogging agents with sulfur-containing sensitizers such as sodium thiosulfate. Furthermore, preferable fogging can also be obtained by combinations of said fogging agents with thiocyanate compounds such as potassium thiocyanate.

The direct-positive photographic silver halide emulsions according to this invention preferably contain electron acceptor. Organic desensitizing dyes known as electron acceptor can usually be defined as substances which have the lowest vacant electron energy level lower than the electron energy level of the silver halide grains. Preferably, they have the highest occupied electron energy level lower than the electron energy level of valence band of silver halide grains. It is known that there is a strong correlation between these electron energy levels and anodic and cathodic halfwave potentials in polarograph. This is described, for example, in Photographic Science and Engineering, Vol. 17, pp 235 to 244 (1973) by R. W. Berriman and P. B. Gilman Jr. and Photographic Science and Engineering, Vol. 18, pp 261 to 275 (1974) by L. Costa, F. Grum and P. B. Gilman Jr. preferable organic desensitizing dyes used in this invention are those having an anodic polarographic halfwave potential more positive than +1.0 volt and a cathodic polarographic halfwave potential more positive than −1.0 volt. These organic desensitizing dyes are described in U.S. Pat. Nos. 2,930,694, 3,367,779, 3,431,111, 3,492,123, 3,501,309, 3,501,310, 3,528,811, 3,574,629, 3,579,344, 3,579,345, 3,582,348, 3,592,653 and 3,598,595, British Pat. No. 1,192,384 and Japanese Patent Publication No. 14,500/68.

Moreover, cyanine dyes and merocyanine dyes which have at least one, preferably two desensitizing substituents such as nitro group are also effective as organic desensitizing dyes.

Specific examples of the desensitizing dyes used in this invention are as follows: pinakryptol yellow, phenosafranine, Methylene Blue, Capri Blue, Amethyst Violet, pinakryptol green, Crystal Violet, 5-m-nitrobenzylidene rhodanine, 3-ethyl-5-m-nitrobenzylidenerhodanine, 3-ethyl-5-(2,4-dinitrobenzylidene)-rhodanine, 5-o-nitrobenzylidenerhodanine, 1',3-diethyl-6-nitrothia-2'-cyanine iodide, 3,3'-diethyl-6,6'-dinitro-9-phenylthiacarbocyanine iodide, 6-chloro-4-nitrobenzotriazole, 2(p-dimethylaminophenyliminomethyl)benzothiazolium ethyl sulfate, 1,3-diamino-5-methylphenazinium chloride, 3,3'-p-nitrobenzyl-thiacarbocyanine bromide, 3,3'-di-o-nitrophenyl-thiacarbocyanine iodide, bis-(4,6-diphenylpyryl-2)-carbocyanine perchlorate, anhydro-2-p-dimethylaminophenyliminomethyl-6-nitro-3-(4-sulfobutyl)benzothiazolium hydroxide, etc. Among them, pinakryptol yellow provides the most preferred result.

Gelatin is mainly used as a protective colloid in the emulsions according to this invention. Furthermore, photographically inert gelatin derivatives and water soluble synthetic polymers (e.g., copolymers of acrylamide, and acrylic acid, polyvinyl alcohol, polyvinyl pyrrolidone, polyvinyl alginates, etc.) may also be used.

The direct-positive photographic silver halide emulsions of this invention can contain various additives such as stabilizers for fogging nuclei, whiteness increasing agents, ultraviolet absorbers, hardeners, surfactants, preservatives, plastisizers, matting agents, color couplers and the like.

The dyes used in this invention may be added also in combination of two or more to give high color sensitivity depending on the object of use. Amount of the dyes added in this invention is $1 \times 10^{-6}$ to $1 \times 10^{-2}$ mols, preferably $3 \times 10^{-5}$ to $5 \times 10^{-3}$ mols per mol of silver halide. These dyes are dissolved in solvents such as water, methanol, ethanol, dimethylformamide, acetone, pyridine, etc. and added to emulsions. Dispersing method by ultrasonic vibration may be used at the time of dissolving the dyes. The dyes may be added to the emulsions at any stage during the preparation of the emulsions, but advantageously, they are added immediately before coating of the emulsions. The organic desensitizing dyes and the known cyanine dyes may also be added in the same amount and in the same manner as mentioned above.

The direct-positive photographic silver halide emulsion according to this invention can be coated on a wide variety of supports. Typical supports are cellulose acetate film, cellulose nitrate film, polyvinyl acetal film, polystyrene film, polyethylene terephthalate film and other polyester films as well as glass, paper, metal, wood and the like. Moreover, supports such as paper which are laminated with plastics may also be used.

The direct-positive photographic silver halide emulsion is processed, after exposure, with processing baths for known development, fixing, bleaching and the like or processing bath comprising combination of them.

The first characteristic of this invention is that the direct-positive photographic silver halide emulsion is spectrally sensitized with a novel dye containing 5,6-dihydropyrrolo[2,1-a]isoquinoline ring.

The second characteristic of this invention is that a high contrast direct-positive photographic silver halide emulsion is obtained using a novel dye containing 5,6-dihydropyrrolo[2,1-a]isoquinoline ring.

The third characteristic of this invention is that the direct-positive photographic silver halide emulsion has no tendency to decrease in maximum density because of the novel dye containing 5,6-dihydropyrrolo[2,1-a]isoquinoline ring.

The fourth characteristic of this invention is that even if the novel dye containing 5,6-dihydropyrrolo[2,1-a]isoquinoline ring is used, no color stain due to the presence of the remaining dye occurs.

The high speed direct-positive photographic silver halide emulsion can be obtained using said novel dye in combination with organic desensitizing dyes.

The higher speed and high contrast direct-positive photographic silver halide emulsion can be obtained using said novel dye in combination with other known cyanine dyes.

The direct-positive photographic silver halide emulsion according to this invention may be used for duplicating photosensitive materials of lith type film, direct-positive color photosensitive materials, photosensitive materials for duplication of microfilm, photosensitive materials for duplication of X-ray film and the like.

The direct-positive photographic silver halide emulsion according to this invention is effective to irradiation not only with light, but with electron rays, X-rays. γ rays and the like.

Furthermore, the novel dye containing 5,6-dihydropyrrolo[2,1-a]isoquinoline ring used in this invention may also be used as filter dyes, antiirradiation dyes and anti-halation dyes.

This invention is further illustrated by the following examples.

EXAMPLE 1

The following A, B, C and D were firstly prepared in the following compositions for preparing a primary emulsion.

| | | |
|---|---|---|
| A | Inert gelatin | 8 g |
| | Aqueous solution (1N) of potassium bromide | 5 ml |
| | Water (60° C.) | 500 ml |
| B | Silver nitrate | 100 g |
| | Water (60° C.) | 500 ml |
| C | Potassium bromide | 70 g |
| | Water (60° C.) | 150 ml |
| D | Inert gelatin | 75 g |

-continued

| | |
|---|---|
| Water | 300 ml |

B and C were added to A while keeping them at 60° C. over the period of 50 minutes with vigorous agitation. Then, the mixture was subjected to physical digestion for 5 minutes and D was added thereto. The mixture was cooled and coagulated and then washed with water. Thus obtained emulsion contained regular cubic silver halide grains having a mean grain diameter of about 0.2μ and (100) plane. The resultant primary emulsion was redissolved and was fogged at 60° C. for 90 minutes with addition of 0.4 mg/mole Ag of thiourea dioxide and 4.0 mg/mole Ag of chloroauric acid. This emulsion was divided and except for one part which was a blank sample, to each of the other parts were added the dyes as shown in Table 1. Then, to all samples were added 200 mg/mole Ag of pinakryptol yellow and a hardener and a surfactant. Thereafter, each sample was coated on cellulose triacetate film at a coverage of about 2.5 g/m$^2$ of silver and dried. Then, these samples were exposed through an optical wedge having a density difference of 0.15 and developed with Kodak D-72 developer at 20° C. for 2 minutes and fixed with an acid hardening fixer. The photographic density of the samples was measured to obtain the characteristics as shown in Table 1.

$D_{max}$ and $D_{min}$ represent the maximum optical density and the minimum optical density, respectively and the sensitivity S is shown by relative value of a reciprocal of exposure measured at the density of 1.0.γ shows the inclination of straight line part between the densities 0.5 and 2.5.

Table 1

| Sample No. | Dyes | Amount of the dye (mg/mole Ag) | S | Γ | $D_{max}$ | $D_{min}$ | Region of spectral sensitization (nm) |
|---|---|---|---|---|---|---|---|
| 1 | blank | — | 100 | 5.0 | 3.20 | .03 | — |
| 2 | (1) | 300 | 178 | 5.1 | 3.13 | .03 | 480 - 600 |
| 3 | (2) | 500 | 204 | 5.0 | 3.10 | .03 | 490 - 610 |
| 4 | (3) | 300 | 151 | 5.3 | 3.08 | .03 | 520 - 640 |
| 5 | (4) | 300 | 316 | 5.0 | 3.12 | .03 | 550 - 670 |
| 6 | (5) | 300 | 468 | 5.1 | 3.04 | .03 | 520 - 640 |
| 7 | (6) | 300 | 832 | 5.2 | 3.12 | .03 | 570 - 690 |
| 8 | (7) | 400 | 135 | 5.0 | 3.11 | .03 | 500 - 620 |
| 9 | (8) | 300 | 589 | 6.0 | 3.20 | .03 | 510 - 630 |
| 10 | (9) | 300 | 417 | 5.0 | 3.03 | .03 | 470 - 590 |
| 11 | (10) | 300 | 851 | 5.0 | 3.12 | .03 | 520 - 640 |
| 12 | (11) | 300 | 154 | 5.0 | 3.04 | .03 | 460 - 580 |
| 13 | (12) | 200 | 224 | 5.0 | 3.14 | .03 | 480 - 600 |
| 14 | (13) | 300 | 229 | 5.1 | 3.07 | .03 | 490 - 610 |
| 15 | (14) | 300 | 200 | 5.0 | 3.12 | .03 | 490 - 610 |
| 16 | (16) | 300 | 132 | 5.1 | 3.20 | .03 | 490 - 610 |
| 17 | (17) | 300 | 132 | 5.0 | 3.12 | .03 | 530 - 650 |
| 18 | (18) | 300 | 224 | 5.0 | 3.08 | .03 | 520 - 640 |
| 19 | (19) | 300 | 132 | 5.0 | 3.12 | .03 | 520 - 640 |
| 20 | (20) | 300 | 132 | 5.0 | 3.07 | .03 | 540 - 660 |
| 21 | (22) | 300 | 154 | 5.1 | 3.13 | .03 | 490 - 610 |
| 22 | (24) | 300 | 254 | 5.1 | 3.08 | .03 | 500 - 620 |
| 23 | (25) | 300 | 195 | 5.1 | 3.06 | .03 | 500 - 620 |
| 24 | (26) | 300 | 314 | 5.0 | 3.15 | .03 | 530 - 650 |
| 25 | (27) | 300 | 219 | 5.4 | 3.17 | .03 | 550 - 670 |
| 26 | (28) | 300 | 186 | 5.0 | 3.11 | .03 | 510 - 630 |
| 27 | (29) | 300 | 154 | 5.1 | 3.12 | .03 | 500 - 620 |
| 28 | (31) | 300 | 251 | 5.7 | 3.14 | .03 | 550 - 670 |
| 29 | (32) | 300 | 154 | 5.1 | 3.11 | .03 | 500 - 620 |
| 30 | (33) | 300 | 453 | 5.1 | 2.96 | .03 | 450 - 560 |
| 31 | (34) | 300 | 421 | 5.5 | 3.12 | .03 | 450 - 560 |
| 32 | (35) | 300 | 386 | 4.9 | 2.89 | .03 | 480 - 600 |
| 33 | (36) | 300 | 314 | 5.1 | 3.09 | .03 | 480 - 600 |
| 34 | (37) | 300 | 317 | 5.1 | 3.10 | .03 | 480 - 600 |
| 35 | (6) + (10) | 150 + 150 | 845 | 5.2 | 3.12 | .03 | 520 - 690 |

As is clear from Table 1, when the dyes of this invention were used, high contrast direct-positive silver halide emulsions which had a high-speed and showed small depression in the maximum density and no increase in the minimum density were obtained.

EXAMPLE 2

Samples were prepared in the same manner as in Example 1 except that dyes were added in accordance with Table 2 and were subjected to sensitometry to obtain the results as shown in Table 2. Comparative dyes (A) and (B) used are disclosed in U.S. Pat. No. 3,431,111 and have the following structures.

Comparative dye (A)

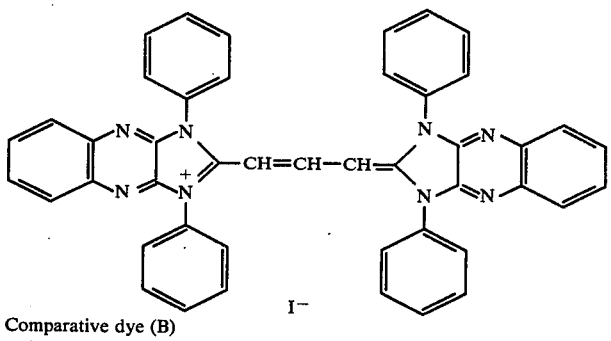

Comparative dye (B)

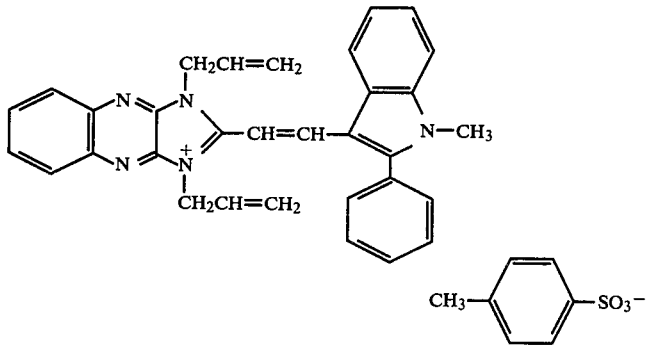

Table 2

| Sample No. | Dyes | Amount of the dye (mg/mole Ag) | S | Γ | $D_{max}$ | $D_{min}$ | Region of spectral sensitization (nm) |
|---|---|---|---|---|---|---|---|
| 1 | blank | — | 100 | 5.0 | 3.20 | .03 | — |
| 2 | (A) | 300 | 832 | 5.0 | 3.08 | .05 | 560 - 680 |
| 3 | (B) | 300 | 845 | 5.1 | 3.11 | .06 | 510 - 620 |
| 4 | (6) | 300 | 832 | 5.2 | 3.12 | .03 | 570 - 690 |
| 5 | (10) | 300 | 851 | 5.0 | 3.12 | .03 | 520 - 620 |

As is clear from Table 2, the dyes (6) and (10) resulted in lower $D_{min}$ than the comparative dyes (A) and (B).

What is claimed is:

1. A direct-positive photographic silver halide emulsion comprising fogged silver halide grains which contains at least one sensitizing dye represented by the following general formula:

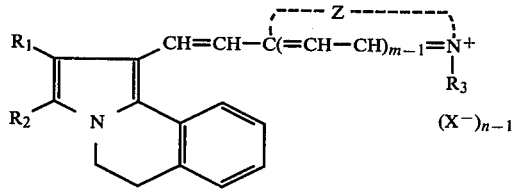

wherein $R_1$ is an alkyl group of 1-6 carbon atoms, a cycloalkyl group of 3-6 carbon atoms, an aralkenyl group, an aryl group, a furyl group, a pyridyl group, a carboxyl group, an alkoxycarbonyl group of 1-6 carbon atoms, carbamoyl group, or an acyl group, $R_2$ is hydrogen atom or the alkyl, aryl, carboxyl, alkoxycarbonyl, carbamoyl or acyl group as defined on $R_1$, $R_3$ is the alkyl group as defined on $R_1$, a hydroxyalkyl group, an acyloxy group, an alkoxyalkyl group, a carboxyalkyl group, an alkoxycarbonylalkyl group, a sulfoalkyl group, an alkenyl group, an aralkyl group or the aryl group as defined on $R_1$, Z is a group of non-metallic atoms necessary for completing an oxazoline ring, an oxazole ring, a benzoxazole ring, a naphthoxazole ring, a thiazoline ring, a thiazole ring, a benzothiazole ring, a naphthothiazole ring, a selenazole ring, a benzoselenazole ring, a naphthoselenazole ring, a 2-pyridine ring, a 4-pyridine ring, a 2-quinoline ring, a 4-quinoline ring, a 1-isoquinoline ring, a 3-isoquinoline ring, an imidazole ring, a benzimidazole ring, a naphthoimidazole ring, an indolenine ring, an imidazo [4,5-b]-quinoxaline ring, a 2-naphthyridine ring, a 4-naphthyridine ring or a pyrroline ring, $X^-$ is an acid anion and m and n each is 1 or 2.

2. A direct-positive photographic silver halide emulsion according to claim 1 wherein the silver halide grains comprise silver bromide or silver iodobromide.

3. A direct-positive photographic silver halide emulsion according to claim 1 wherein the sensitizing dye is the one having said general formula in which $R_1$ is an aryl group and $R_2$ is hydrogen atom.

4. A direct-positive photographic silver halide emulsion according to claim 1, wherein the sensitizing dye is the one having said general formula in which $R_1$ is an aryl group and $R_2$ is an alkoxycarbonyl group.

5. A direct-positive photographic silver halide emulsion according to claim 1, wherein the content of the sensitizing dye is $1 \times 10^{-6}$ to $1 \times 10^{-2}$ mols per mol of silver halide.

6. A direct-positive photographic silver halide emulsion according to claim 1, which contains an electron trapping agent in addition to the sensitizing dye.

7. A direct-positive photographic silver halide emulsion according to claim 1, wherein said sensitizing dye is

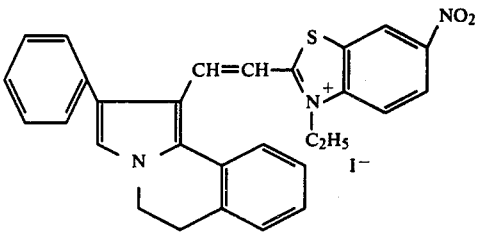

8. A direct-positive photographic silver halide emulsion according to claim 1, wherein said sensitizing dye is

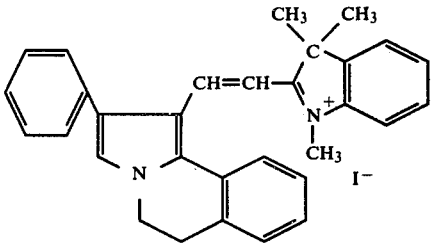

9. A direct-positive photographic silver halide emulsion according to claim 1, wherein said sensitizing dye is

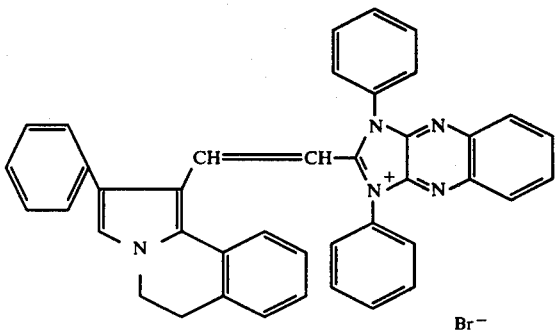

10. A direct-positive photographic silver halide emulsion according to claim 1, wherein said sensitizing dye is

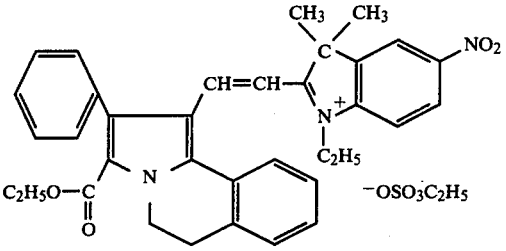

11. A direct-positive photographic silver halide emulsion according to claim 1, wherein said sensitizing dye is

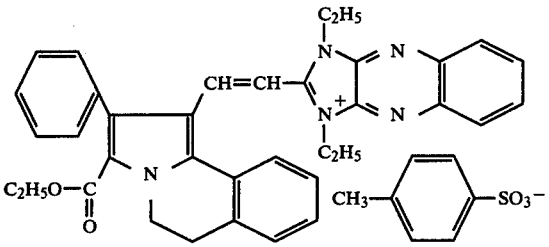

12. A direct-positive photographic silver halide emulsion according to claim 1, wherein said sensitizing dye is

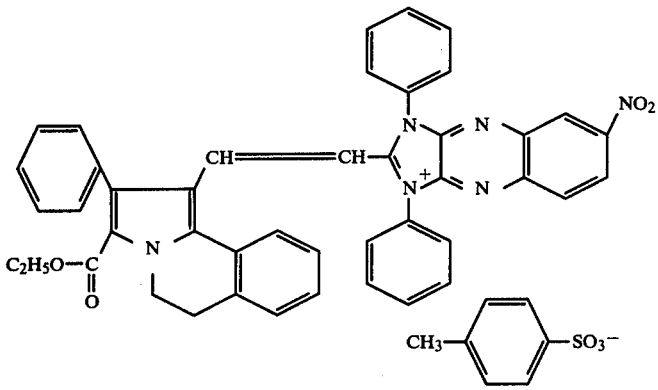

13. A direct-positive photographic silver halide emulsion according to claim 1, wherein said sensitizing dye is

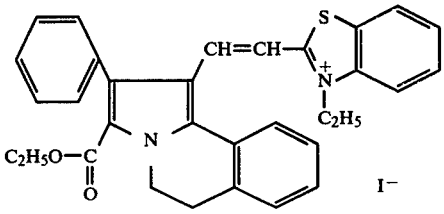

14. A direct-positive photographic silver halide emulsion according to claim 1, wherein said sensitizing dye is

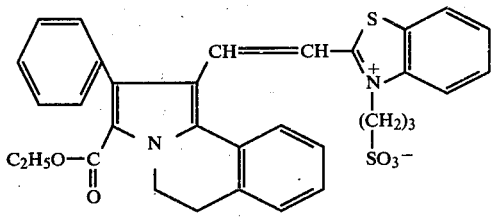

15. A direct-positive photographic silver halide emulsion according to claim 1, wherein said sensitizing dye is

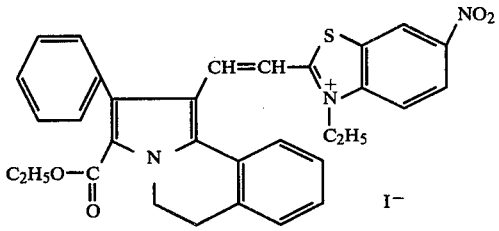

16. A direct-positive photographic silver halide emulsion according to claim 1, wherein said sensitizing dye is

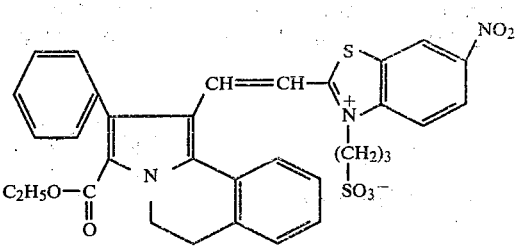

17. A direct-positive photographic silver halide emulsion according to claim 1, wherein said sensitizing dye is

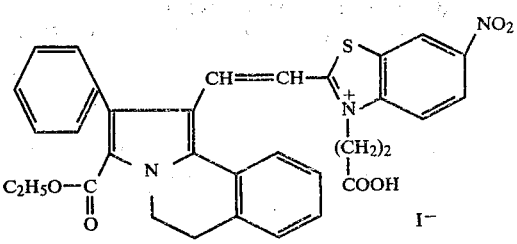

18. A photographic element comprising a support and at least one layer comprising at least one direct-positive photographic silver halide emulsion comprising fogged silver halide grains containing at least one sensitizing dye according to claim 1.

19. A direct-positive photographic silver halide emulsion according to claim 1 which contains as an electron trapping agent an organic desensitizing dye in addition to the sensitizing dye.

20. A direct-positive photographic silver halide emulsion according to claim 1 which contains an electron accepter in addition to the sensitizing dye.

* * * * *